US010875149B2

(12) United States Patent
Chen et al.

(10) Patent No.: US 10,875,149 B2
(45) Date of Patent: Dec. 29, 2020

(54) APPARATUS AND METHOD FOR TIMED DISPENSING VARIOUS SLURRY COMPONENTS

(71) Applicant: Taiwan Semiconductor Manufacturing Co., Ltd., Hsinchu (TW)

(72) Inventors: Kei-Wei Chen, Tainan (TW); Chih-Hung Chen, Hsinchu (TW); Ying-Lang Wang, Taichung (TW)

(73) Assignee: TAIWAN SEMICONDUCTOR MANUFACTURING CO., LTD., Hsinchu (TW)

( * ) Notice: Subject to any disclaimer, the term of this patent is extended or adjusted under 35 U.S.C. 154(b) by 79 days.

(21) Appl. No.: 15/646,414

(22) Filed: Jul. 11, 2017

(65) Prior Publication Data

US 2018/0281152 A1 Oct. 4, 2018

Related U.S. Application Data

(60) Provisional application No. 62/478,673, filed on Mar. 30, 2017.

(51) Int. Cl.
*B24B 57/02* (2006.01)
*B24B 37/04* (2012.01)
(Continued)

(52) U.S. Cl.
CPC ..... *B24B 57/02* (2013.01); *B24B 37/013* (2013.01); *B24B 37/04* (2013.01); *B24B 37/105* (2013.01); *B24B 37/205* (2013.01)

(58) Field of Classification Search
None
See application file for complete search history.

(56) References Cited

U.S. PATENT DOCUMENTS 5,664,990 A * 9/1997 Adams ..... B24B 37/04 451/60
5,876,508 A * 3/1999 Wu ..... B08B 3/02 134/2
(Continued)

FOREIGN PATENT DOCUMENTS

JP 2004022804 A * 1/2004 ..... H01L 21/3065

OTHER PUBLICATIONS

Machine Generated English Translation of abstract of JP2004-22804. Published Jan. 22, 2004. (Year: 2004).*
(Continued)

*Primary Examiner* — Sylvia Macarthur
(74) *Attorney, Agent, or Firm* — McClure, Qualey & Rodack, LLP

(57) ABSTRACT

A slurry dispensing unit for a chemical mechanical polishing (CMP) apparatus is provided. The slurry dispensing unit includes a nozzle, a mixer, a first fluid source, and a second fluid source. The nozzle is configured to dispense a slurry. The mixer is disposed upstream of the nozzle. The first fluid source is connected to the mixer through a first pipe and configured to provide a first fluid including a first component of the slurry. The second fluid source is connected to the mixer through a second pipe and configured to provide a second fluid including a second component of the slurry, wherein the second component is different from the first component.

20 Claims, 10 Drawing Sheets

(51) Int. Cl.
*B24B 37/013* (2012.01)
*B24B 37/20* (2012.01)
*B24B 37/10* (2012.01)

(56) References Cited

U.S. PATENT DOCUMENTS 6,059,920 A * 5/2000 Nojo ..... B24B 37/04 156/345.12
6,183,351 B1 * 2/2001 Aoki ..... B24B 57/02 210/739
6,375,791 B1 * 4/2002 Chiesl, III ..... B24B 37/345 156/345.12
6,516,815 B1 * 2/2003 Stevens ..... H01L 21/6708 134/147
7,727,049 B2 * 6/2010 Benvegnu ..... B24B 37/013 451/285
8,277,281 B2 * 10/2012 Finarov ..... B24B 37/013 451/5
8,845,852 B2 * 9/2014 Nakamori ..... B24B 37/205 156/345.12
9,067,295 B2 * 6/2015 Deshpande ..... B24B 37/005
9,305,850 B2 * 4/2016 Kozasa ..... H01L 21/31116
2002/0007913 A1 * 1/2002 Gonzales ..... B24B 37/013 156/345.12
2002/0048214 A1 * 4/2002 Lin ..... B01F 5/0646 366/154.2
2002/0187731 A1 * 12/2002 Chen ..... B24B 53/017 451/36
2002/0187735 A1 * 12/2002 Nabeya ..... B24B 37/26 451/67
2003/0228830 A1 * 12/2003 Sakai ..... B24B 37/04 451/8
2005/0202763 A1 * 9/2005 Chen ..... B24B 37/044 451/60
2006/0191871 A1 * 8/2006 Chen ..... B24B 37/04 216/89
2006/0264157 A1 * 11/2006 Hashii ..... B24B 37/04 451/41
2010/0130101 A1 * 5/2010 Wang ..... B24B 37/042 451/8
2015/0147888 A1 * 5/2015 Nonaka ..... H01L 21/6708 438/748
2016/0167195 A1 * 6/2016 Diao ..... B24B 53/017 216/53
2017/0259395 A1 * 9/2017 Kobata ..... B24B 37/013
2017/0297163 A1 * 10/2017 Bajaj ..... H01L 21/30625
2018/0281152 A1 * 10/2018 Chen ..... B24B 37/105

OTHER PUBLICATIONS

Machine Generated English Translation of description of JP2004-22804.Published Jan. 22, 2004. (Year: 2004).*
Machine Generated English Translation of claims of JP2004-22804. Published Jan. 22, 2004. (Year: 2004).*

* cited by examiner

APPARATUS AND METHOD FOR TIMED DISPENSING VARIOUS SLURRY COMPONENTS

CROSS REFERENCE TO RELATED APPLICATIONS

The present application claims priority of U.S. Provisional Application No. 62/478,673, filed on Mar. 30, 2017, the entirety of which is incorporated by reference herein.

BACKGROUND

Chemical Mechanical Polishing (CMP) is one type of process used in the manufacture of semiconductor devices. CMP is a process used to smooth and planarize the surfaces of wafers using a combination of chemical and mechanical forces. Integrated circuit (IC) dies in wafer form are placed into a chamber of a CMP apparatus and are planarized or polished at various stages of the manufacturing process. CMP processes may be used to form planar surfaces on dielectric layers, semiconductor layers, and conductive material layers of a wafer, for example.

CMP apparatuses typically have a rotatable platen with a polishing pad attached thereto. In some CMP processes, a semiconductor wafer is placed upside down against the polishing pad using a predetermined amount of pressure. A liquid dispersion referred to as slurry that contains chemicals and microabrasive grains is applied to the polishing pad during the CMP process while the wafer is held against the rotating polishing pad. The wafer is also rotated in some applications.

Although existing devices and methods for CMP processes have been generally adequate for their intended purposes, they have not been entirely satisfactory in all respects. Consequently, it is desirable to provide a solution for polishing wafers in CMP apparatuses.

BRIEF DESCRIPTION OF THE DRAWINGS

For a more complete understanding of the present disclosure, and the advantages of the present disclosure, reference is now made to the following descriptions taken in conjunction with the accompanying drawings, in which.

DETAILED DESCRIPTION

Figure 1:
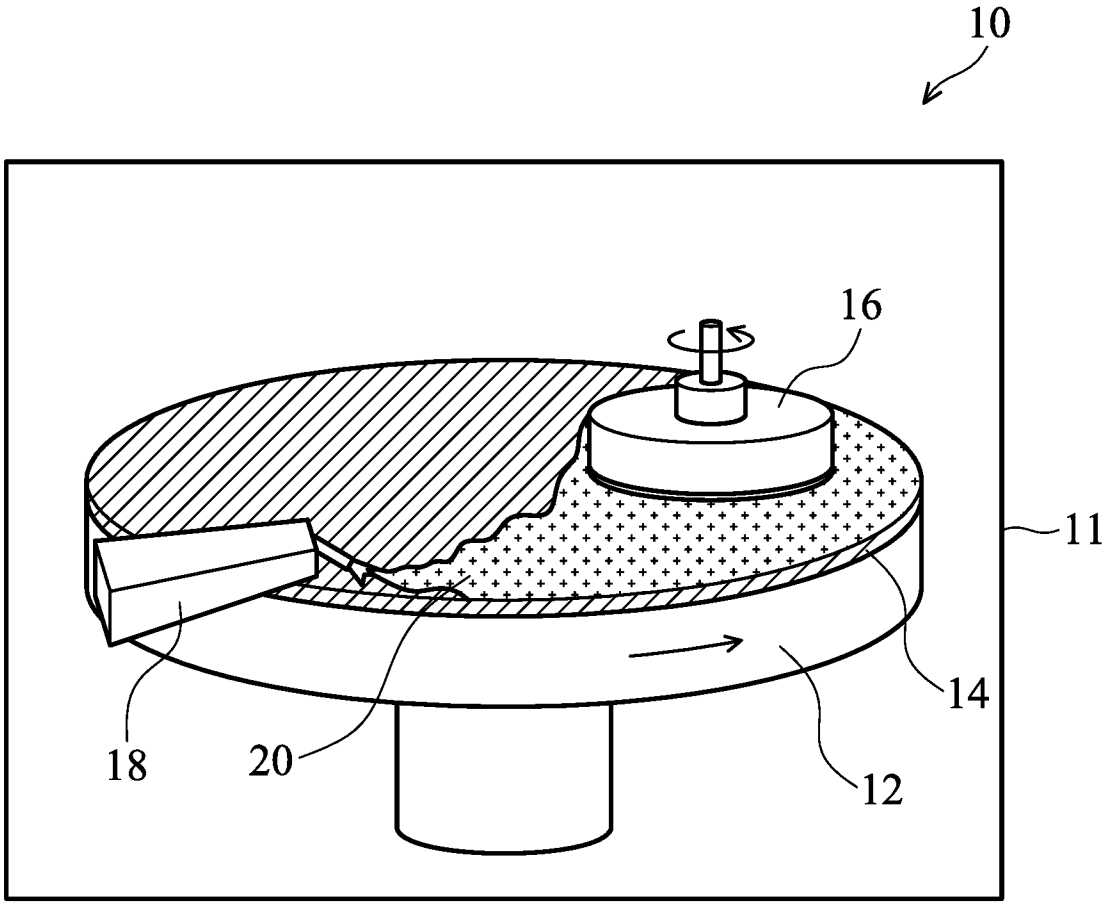
FIG. 1 is a schematic diagram of a Chemical Mechanical Polishing (CMP) apparatus, in accordance with some embodiments.

The following disclosure provides many different embodiments, or examples, for implementing different features of the invention. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact.

In addition, the present disclosure may repeat reference numerals and/or letters in the various examples. This repetition is for the purpose of simplicity and clarity and does not in itself dictate a relationship between the various embodiments and/or configurations discussed. Various features may be arbitrarily drawn in different scales for the sake of simplicity and clarity.

Furthermore, spatially relative terms, such as "underlying," "below," "lower," "overlying," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

A Chemical Mechanical Polishing (CMP) apparatus is provided in accordance with various exemplary embodiments. The variations of some embodiments are discussed. Throughout the various views and illustrative embodiments, like reference numbers are used to designate like elements. The embodiments of the present disclosure also include the scope of using the CMP apparatus in accordance with the embodiments to manufacture integrated circuits. For example, the CMP apparatus is used to planarize and polish wafers, in which integrated circuits are formed, by a CMP process.

FIG. 1 schematically illustrates a perspective view of partial components of a CMP apparatus 10 in accordance with some embodiments of the present disclosure. The CMP apparatus 10 is used to form planar surfaces on dielectric layers, semiconductor layers, and/or conductive material layers of one or more wafers W (see FIGS. 2 to 8). The wafer W may be made of silicon or other semiconductor materials. Alternatively or additionally, the wafer W may comprise other elementary semiconductor materials such as germanium (Ge). In accordance with some embodiments, the wafer W is made of a compound semiconductor such as silicon carbide (SiC), gallium arsenic (GaAs), indium arsenide (InAs), or indium phosphide (InP). In accordance with some embodiments, the wafer W is made of an alloy semiconductor such as silicon germanium (SiGe), silicon germanium carbide (SiGeC), gallium arsenic phosphide (GaAsP), or gallium indium phosphide (GaInP). In accordance with some embodiments, the wafer W comprises an epitaxial layer. For example, the wafer W has an epitaxial layer overlying a bulk semiconductor. In some other embodiments, the wafer W is a silicon-on-insulator (SOI) or a germanium-on-insulator (GOI) substrate.

As shown in FIG. 1, the CMP apparatus 10 includes a housing 11 which provides a sealed, contained system for the components of the CMP apparatus 10 as described below. One or more load ports (not shown) may be coupled to the housing 11 for allowing a wafer or wafers to enter and exit the CMP apparatus 10.

The CMP apparatus 10 also includes a polishing platen 12, a polishing pad 14 over the polishing platen 12, and a polishing head 16 over the polishing pad 14. A slurry dispensing unit 18 has an outlet directly over the polishing pad 14 in order to dispense a slurry 20 onto the polishing pad 14.

During the CMP process, the slurry 20 is dispensed by the slurry dispensing unit 18 onto the polishing pad 14. In accordance with some embodiments, the slurry dispensing unit 18 comprises a pivotable arm coupled to a driving mechanism (not shown), so that the slurry dispensing unit 18 can be moved towards or away from the polishing pad 14. In addition, the slurry dispensing unit 18 may be attached to or comprise a tank or reservoir (not shown) that holds a supply of the slurry 20. The slurry 20 includes reactive chemicals that react with the surface of the wafer. Also, the slurry 20 includes abrasive particles for mechanically polishing the wafer.

The polishing pad 14 is formed of a material that is hard enough to allow the abrasive particles in the slurry 20 to mechanically polish the wafer W (see FIGS. 6 to 8), which is under the polishing head 16. On the other hand, the polishing pad 14 is also soft enough so that it does not substantially scratch the wafer W. The polishing pad 14 is removable and is attachable to the polishing platen 12 by an adhesive film, adhesive, or glue, for example. During the CMP process, the polishing platen 12 is rotated by a driving mechanism, such as motor (not shown), and hence the polishing pad 14 fixed thereon is also rotated along with the polishing platen 12.

During the CMP process, the polishing head 16 is also rotated by a driving mechanism (not shown), causing the rotation of the wafer W (see FIGS. 6 to 8) affixed to the polishing head 16. In accordance with some embodiments, as shown in FIG. 1, the polishing head 16 and the polishing pad 14 rotate in the same direction (clockwise or counterclockwise). In accordance with alternative embodiments, the polishing head 16 and the polishing pad 14 rotate in opposite directions. With the rotation of the polishing pad 14 and the polishing head 16, the slurry 20 flows between the wafer and the polishing pad 14 through, for example, the surface grooves (not shown) on the surface of the polishing pad 14. In addition, the polishing head 16 generates a pressure to presses the wafer W against the polishing pad 14 during the CMP process, and the wafer W is located in the space defined by a retaining ring (not shown) which is provided on the bottom surface of the polishing head 16. Through the chemical reaction between the reactive chemicals in the slurry 20 and the surface of the wafer, and further through the mechanical polishing, the surface of the wafer is planarized.

Although not shown in FIG. 1, the CMP apparatus 10 may also include other components. For example, a rotatable diamond disk may also be placed over the polishing pad 14, which is configured to remove undesirable by-products during the CMP process. The diamond disk comprises embedded or encapsulated cut diamond particles on a substrate, in accordance with some embodiments. Also, the diamond disk comes into contact with the surface of the polishing pad 14 when the polishing pad 14 is to be conditioned. During the conditioning, both the polishing pad 14 and the diamond disk rotate, so that the protrusions or cutting edges of the diamond disk move relative to the surface of the polishing pad 14, thereby polishing and re-texturizing the surface of the polishing pad 14. Furthermore, the CMP apparatus 10 may also include a liquid dispenser in order to dispense a washing liquid, such as de-ionized water (DI water), onto the surface of the polishing pad 14, so that the particles and the slurry 20 that remain on the surface of the polishing pad 14 after the CMP process are washed away.

In general, a CMP process comprises various processing stages, such as main polishing stage, transition stage, over polishing stage, and final stage. FIGS. 2 to 5 are cross-sectional views illustrating various processing stages of a CMP process in accordance with some embodiments, wherein the CMP process is performed so as to remove a metallic layer (for example, tungsten layer) on a wafer and stop polishing on a dielectric layer (for example, nitride layer) below the metallic layer.

Figure 2:
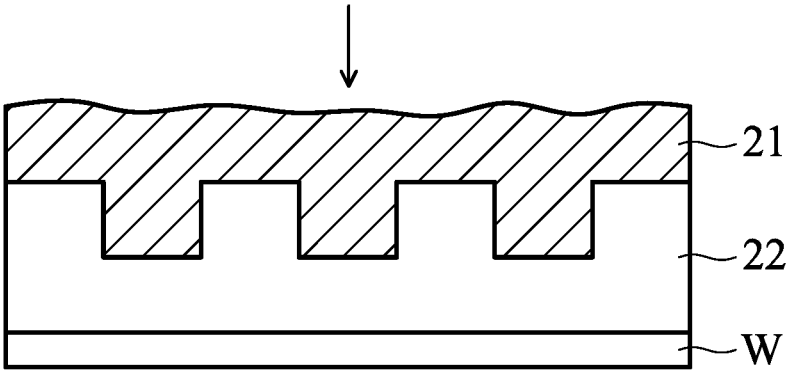
FIG. 2 is a cross-sectional view illustrating a main polishing stage of a CMP process for removing a metallic layer on a wafer, in accordance with some embodiments.

Referring to FIG. 2, which is a cross-sectional view illustrating a main polishing stage of a CMP process for removing a metallic layer 21 on a wafer W, in accordance with some embodiments. The wafer W has a dielectric layer 22 thereon. The metallic layer 21 needing planarization is formed over the dielectric layer 22. In accordance with some embodiments, one or more other layers such as dielectric layers, semiconductor layers, and conductive material layers may also be formed between the dielectric layer 22 and the wafer W. In the main polishing stage, the metallic layer 21 is removed quickly through the chemical mechanical polishing.

In accordance with some embodiments, in order to rapidly remove the metallic layer 21, the slurry components of the slurry 20 (FIG. 1) that the main polishing stage needs may comprise large size abrasive particles (for example, the abrasive comprising $SiO_2$, $Al_2O_3$, $CeO_2$, W, and the like), pH buffer solutions (for example, KOH, $NH_4OH$, $HNO_3$, organic acids, and the like), oxidants (for example, $H_2O_2$, ferric nitrate, $KIO_3$, and the like), and surfactants (for example, organic compound such as peracetic acid, amino acid, or benzyl polyethylene glycol). The pH buffer solutions are used to help the abrasive particles to be uniform in the slurry. The oxidants are used so that the metallic layer 21 is oxidized, and hence the metallic layer 21 can be easily removed and polished. The surfactants are also used to help the abrasive particles to be uniform in the slurry and to enhance the planarity for the CMP process (it should be understood that the higher CMP planarity means that only the high spots of the polishing surface are polished, but the low spots of the polishing surface are not polished).

Figure 3:
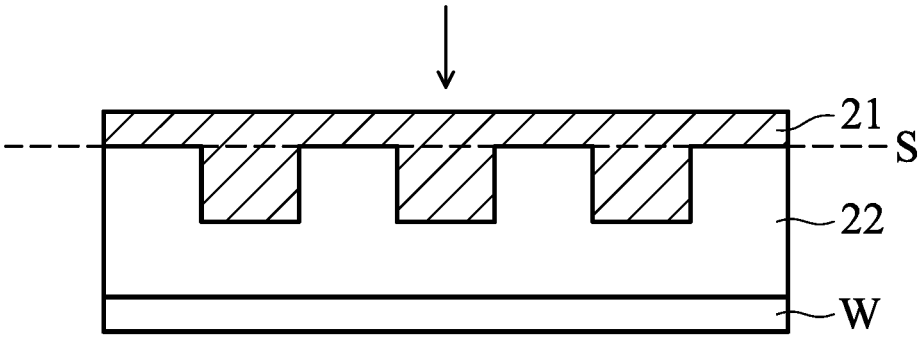
FIG. 3 is a cross-sectional view illustrating a transition stage of a CMP process for stopping the polishing on a dielectric layer below the metallic layer, in accordance with some embodiments.

FIG. 3 is a cross-sectional view illustrating a transition stage of a CMP process for stopping the polishing on a dielectric layer 22 below the metallic layer 21, in accordance with some embodiments. As shown in FIG. 3, after the main polishing stage, the metallic layer 21 is almost completely removed, and the dielectric layer 22 is about to show. Since the metallic layer 21 remaining on the dielectric layer 22 is minimal, the removal rate of the metallic layer 21 will be reduced in the transition stage, for example through reducing the polishing pressure from the polishing head 16. Also, in the transition stage, the dielectric layer 22 below the metallic layer 21 will not be polished (or will only be slightly polished) after the metallic layer 21 on the dielectric layer 22 is removed. In other words, the polishing in the transition stage stops substantially on the upper surface of the dielectric layer 22, as depicted by the dotted line S in FIG. 3.

In accordance with some embodiments, the slurry components of the slurry 20 (FIG. 1) that the transition stage needs may comprise the abrasive particles, pH buffer solutions, oxidants and surfactants used in the main polishing stage, and polishing rate inhibitors (for example, dielectric inhibitor such as peracetic acid) in order to stop the polishing on the dielectric layer 22 below the metallic layer 21

Figure 4:
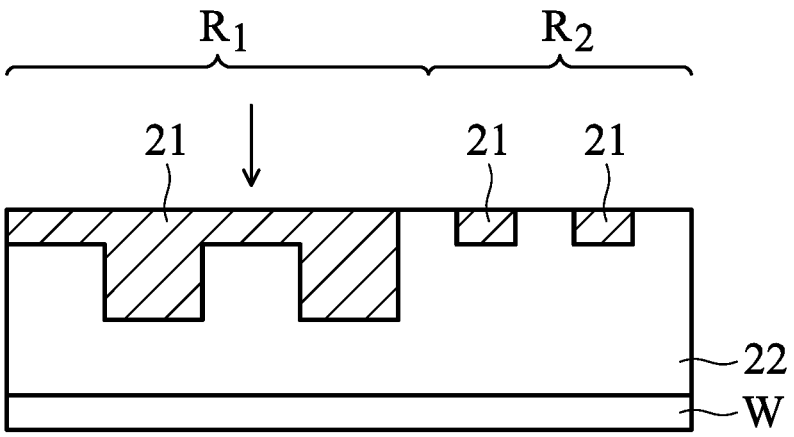
FIG. 4 is a cross-sectional view illustrating an over polishing stage of a CMP process for removing the metallic layer remaining in other regions or dies of the wafer, in accordance with some embodiments.

Referring to FIG. 4, which is a cross-sectional view illustrating an over polishing stage of a CMP process for removing the metallic layer 21 remaining on the upper surface of the dielectric layer 22 in other regions or dies of the wafer W, in accordance with some embodiments. It should be understood that the dielectric layer 22 corresponding to different regions or dies of the wafer W may have different surface morphology. For example, as shown in FIG. 4, the illustrated portion of the wafer W is different from the illustrated portion of the wafer W in FIG. 3, wherein the upper surface of the dielectric layer 22 in the region R1 of the wafer W is lower than the upper surface of dielectric layer 22 in the region R2 of the wafer W. Consequently, when the metallic layer 21 on the upper surface of the dielectric layer 22 in the region R2 is removed (i.e. the dielectric layer 22 in the region R2 starts to show) at the end of the transition stage, the metallic layer 21 on the upper surface of the dielectric layer 22 in the region R1 may not be completely removed. The over polish (FIG. 4) is performed in order to completely remove the metallic layer 21 on the upper surface of the dielectric layer 22 of the whole wafer W. Also, in the over polishing stage, the dielectric layer 22 will not be polished or will only be slightly polished.

In accordance with some embodiments, in order to completely remove the metallic layer 21 on the upper surface of the dielectric layer 22 of the whole wafer W and avoid polishing the dielectric layer 22, the slurry components of the slurry 20 (FIG. 1) that the over polishing stage needs may comprise small size abrasive particles, pH buffer solutions, oxidants, surfactants, and polishing rate inhibitors.

Figure 5:
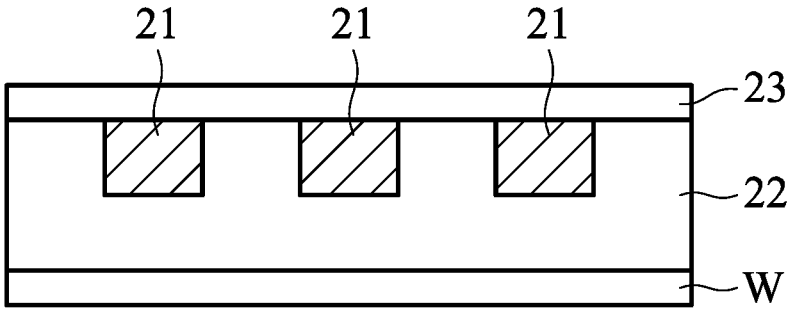
FIG. 5 is a cross-sectional view illustrating a final stage of a CMP process for performing surface treatment on the wafer surface, in accordance with some embodiments.

Referring to FIG. 5, which is a cross-sectional view illustrating a final stage of a CMP process for performing surface treatment on the wafer surface, in accordance with some embodiments. As shown in FIG. 5, after the over polish is completed, the planarization of the metallic layer 21 and dielectric layer 22 on the wafer W is achieved. Furthermore, in the final stage, at least one surface treatment material 23 is applied to the wafer surface (i.e. the surfaces of the metallic layer 21 and dielectric layer 22) for protecting and/or modifying the polished wafer surface. For example, the surface treatment material 23 may be a corrosion inhibitor, such as benzotriazole (BTA), which can prevent rust in the polished metallic layer 21. Alternatively or additionally, the surface treatment material 23 may be a hydrophilic material, such as polyethylene glycol or a polymer containing hydrophilic OH groups, which can facilitate easy cleaning of the polished wafer surface after the CMP process.

The processing stages of the CMP process described above are examples, and the CMP process may also comprise other processing stages and/or order of stages.

As described above, various processing stages of the CMP process have different purposes and intentions, and hence respectively needing different slurry components, for example, different sizes of abrasive particles, pH buffer solutions, oxidants, surfactants, polishing rate inhibitors, corrosion inhibitor, and/or hydrophilic material.

It should be understood that, if the slurry components are selectively injected onto the polishing pad when needed for the specific processing stages of the CMP process, the performance of CMP process can be enhanced. In contrast, if the slurry components are premixed and dispensed together onto the polishing pad during the entire CMP process, some components designed for specific processing stages of the CMP process may work against other processing stages. For example, the corrosion inhibitor is designed for the final stage and may adversely affect the performance of the main polishing stage (i.e. slow down the polishing rate due to protection/anticorrosion effect of the corrosion inhibitor) when it is added at beginning of the CMP process.

In addition, if the slurry components are selectively injected onto the polishing pad when needed in the specific processing stages of the CMP process, the undesired interaction among the slurry components that are needed for different processing stages and the usage amount (or the cost) of the slurry for the CMP process can also be effectively reduced. For example, $H_2O_2$ is a commonly used slurry component (oxidant), but it degrades quickly after being mixed into the slurry. Hence, if the addition of $H_2O_2$ is timed to the specific processing stages, rather than being mixed with other slurry components during the entire CMP process, concerns over compatibility can be ignored and the cost can be reduced.

Consequently, in order to supply different slurry components according to various processing stages of the CMP process, the CMP apparatus in accordance with some embodiments of the present disclosure further includes a detection unit (see FIGS. 6 to 8) for detecting and determining the endpoints of, for example, the main polishing stage, transition stage, and over polishing stage of a CMP process, and a slurry dispensing unit (see FIGS. 9 to 12) for mixing and selectively dispensing different slurry components onto the polishing pad.

Figure 6:
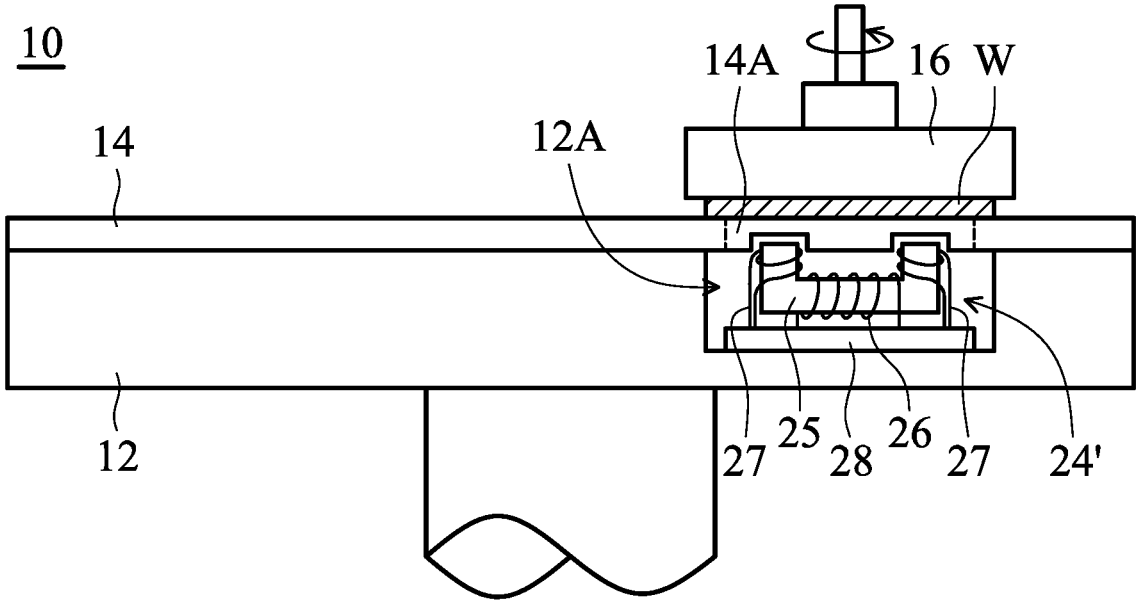
FIG. 6 is a cross-sectional view illustrating a current detection unit for detecting the endpoints of various steps of a CMP process, in accordance with some embodiments.

Referring to FIG. 6, which is a cross-sectional view illustrating a current detection unit 24' provided to the CMP apparatus 10 in FIG. 1 for detecting the endpoints of various steps of a CMP process, in accordance with some embodiments. The current detection unit 24' includes a magnetic core 25 disposed in a recess 12A of the polishing platen 12. The magnetic core 25 is rotatable along with the polishing platen 12. The current detection unit 24' also includes a first coil 26 (driving coil) wound on a first part of the magnetic core 25 and at least one second coil 27 (induction coil) wound on a second part of the magnetic core 25. The first coil 26 and the second coil 27 are electrically connected to a circuit board 28. During the CMP process, the circuit board 28 can provide a driving current, causing the first coil 26 to generate a magnetic field passing through the magnetic core 25. At the same time, some magnetic fields can pass through a window 14A of the polishing pad 14 to reach the surface of the wafer W which is under the polishing head 16. If the surface of the wafer W has metallic layers (or conductive layers) thereon, an eddy current will be induced thereon. The magnetic flux generated from the eddy current may cause variation (for example, the amplitude variation) of the induced current on the second coil 27. A detector (not shown) coupled to the circuit board 28 can detect the variation of the induced current on the second coil 27 by measuring the impedance changes of the second coil 27.

When the thickness of the metallic layers (or conductive layers) on the wafer W changes during the CMP process, the induced eddy current also changes, resulting in the impedance variation of the second coil 27. Therefore, the current detection unit 24' can detect the thickness variation of the metallic layers on the wafer W by measuring the impedance variation of the second coil 27, thereby detecting and determining the endpoints of, for example, the main polishing stage, transition stage, and over polishing stage of the CMP process.

Figure 7:
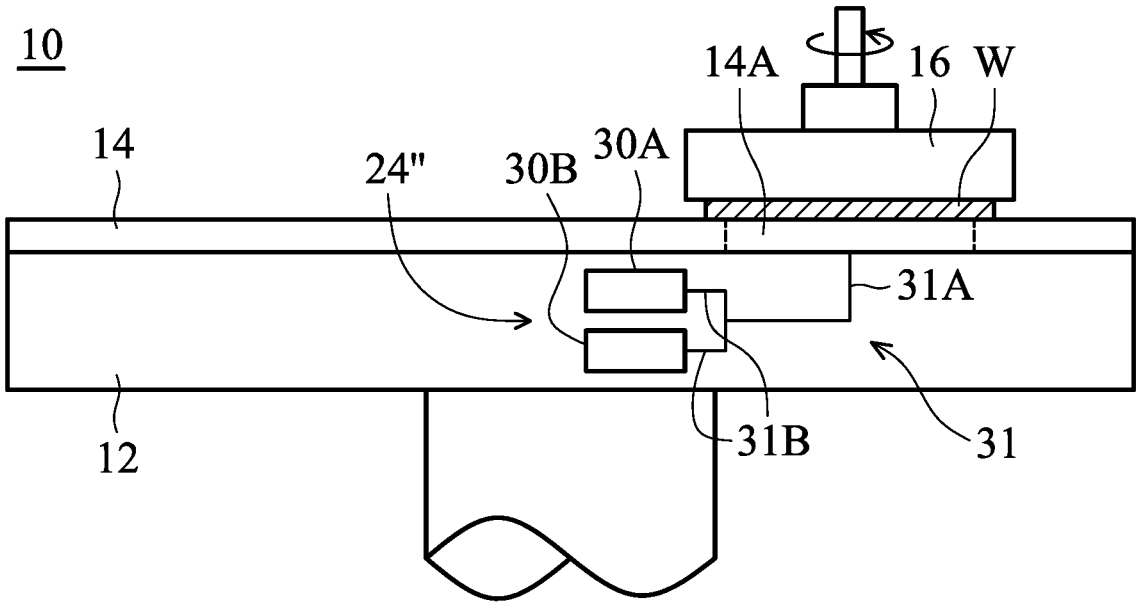
FIG. 7 is a cross-sectional view illustrating an optical detection unit for detecting the endpoints of various steps of a CMP process, in accordance with some embodiments.

FIG. 7 is a cross-sectional view illustrating an optical detection unit 24" provided to the CMP apparatus 10 in FIG. 1 for detecting the endpoints of various steps of a CMP process, in accordance with some embodiments. The optical detection unit 24" is disposed within the polishing platen 12 and includes a light source 30A and a light detector 30B. During the CMP process, the light source 30A can generate a light beam such as a white light beam. In accordance with some embodiments, the light source 30A is a Xenon lamp or a Mercury-Xenon lamp. The light beam from the light source 30A can pass through a (optical) window 14A of the polishing pad 14 and is projected onto the surface of the wafer W which is under the polishing head 16. Then, the reflected light beam from the surface of the wafer W can pass through the window 14A again and is received by the light detector 30B. In accordance with some embodiments, the light detector 30B is a spectrometer (such as a grating spectrometer) which can measure optical properties (for example, the amplitude) of the reflected light beam. In addition, the optical detection unit 24" also includes a bifurcated cable 31 including a trunk 31A and two branches 31B for allowing the light beam to be transmitted from the light source 30A to the window 14A and the light beam to be transmitted back from the window 14A to the light detector 30B.

When the thickness of the films/layers on the wafer W changes during the CMP process, the optical properties of the reflected light beam also changes. Therefore, the optical detection unit 24" can detect the thickness variation of the films/layers on the wafer W by measuring the variation of the optical properties (such as amplitude) of the reflected light beam, thereby detecting and determining the endpoints of, for example, the main polishing stage, transition stage, and over polishing stage of the CMP process. The optical detection unit 24" is applicable to detect the thickness variation of dielectric films/layers on the wafer W.

Figure 8:
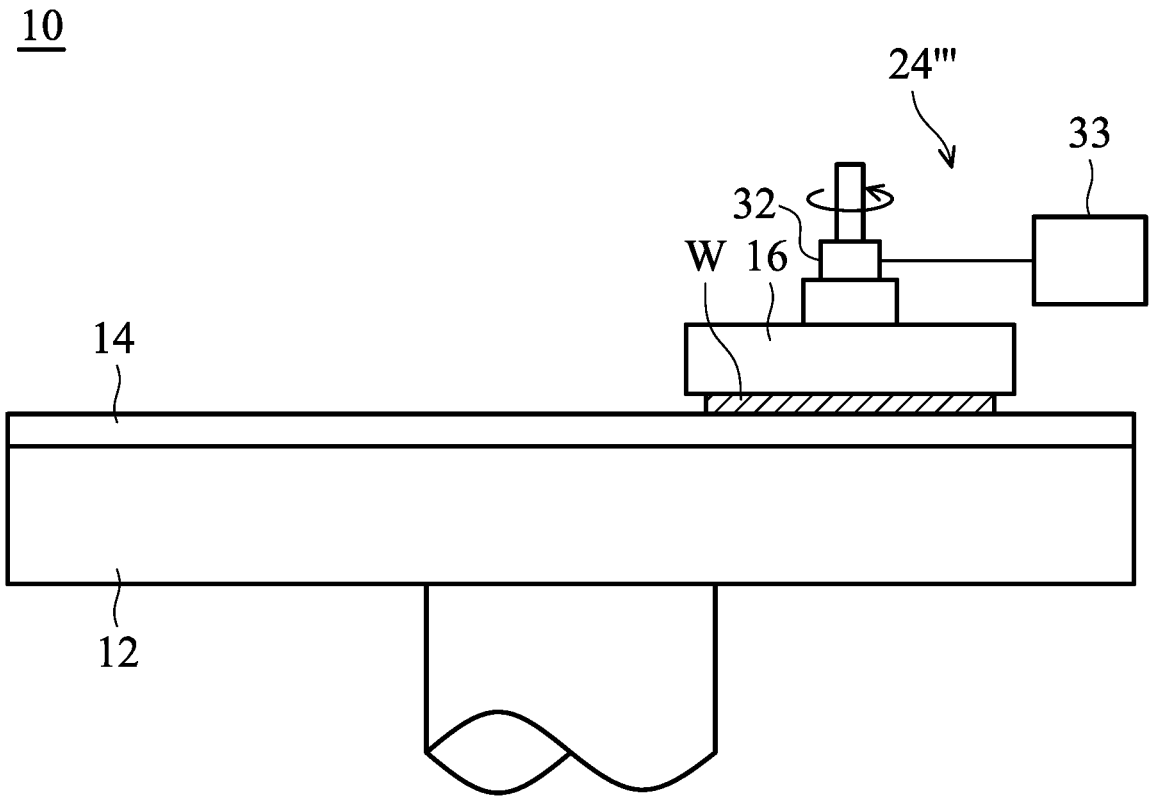
FIG. 8 is a cross-sectional view illustrating a friction detection unit for detecting the endpoints of various steps of a CMP process, in accordance with some embodiments.

FIG. 8 is a cross-sectional view illustrating a friction detection unit 24''' provided to the CMP apparatus 10 in FIG. 1 for detecting the endpoints of various steps of a CMP process, in accordance with some embodiments. The friction detection unit 24''' includes a torsion meter 32 coupled to the shift of the polishing head 16 and a detector 33 electrically to the torsion meter 32 for reading the data measured by the torsion meter 32.

When the CMP process proceeds to an interface between two different material layers on the wafer W which is under the polishing head 16, the friction between the polishing pad 14 and the wafer W will change. Also, the variation of the friction between the polishing pad 14 and the wafer W causes the torsion variation of the shift of the polishing head 16 which can be detected by the torsion meter 32 and the detector 33. Therefore, the friction detection unit 24''' can detect and determine the endpoints of various processing stages of the CMP process.

The detection units 24', 24" and 24''' described above are examples, and the CMP apparatus 10 may also include other sensing components, such as lasers, light-emitting diodes, acoustic detectors, resistivity detectors, and the like, for detecting the endpoints of various processing stages of the CMP process. In accordance with some embodiments, two or more detection units described above are also used together. It should also be noted that the detection units described above are in-situ detection units which can directly detect the endpoints of various processing stages of the CMP process without stopping the polishing work and moving the wafer to an external detection station for detection, and hence saving the time for the CMP process.

Figure 9:
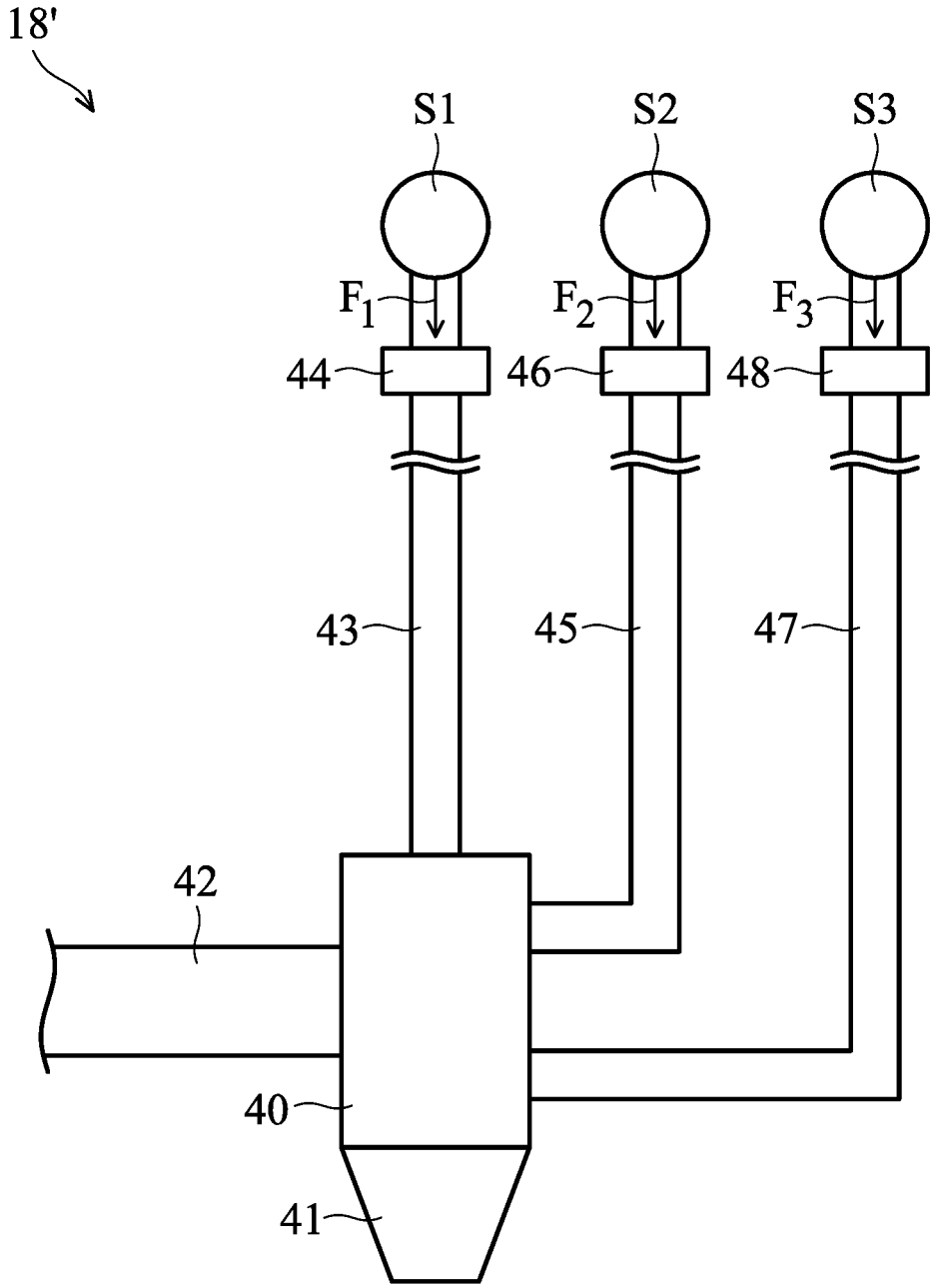
FIG. 9 is a schematic diagram of partial elements of a slurry dispensing unit, in accordance with some embodiments.

Next, referring to FIG. 9, a slurry dispensing unit 18' is also provided to the CMP apparatus 10 (FIG. 1) for mixing and selectively dispensing different slurry components onto the polishing pad 14 (FIG. 1) according to various processing stages of the CMP process, in accordance with some embodiments.

As shown in FIG. 9, the slurry dispensing unit 18' includes a main body 40 and a nozzle 41 formed on a side of the main body 40 for dispensing a slurry onto the polishing pad 14 (FIG. 1). In accordance with some embodiments, the main body 40 is connected to a pivotable arm 42 that is coupled to a driving mechanism (not shown), so that the slurry dispensing unit 18' can be moved towards or away from the polishing pad 14.

The slurry dispensing unit 18' also includes a first pipe 43 and a second pipe 45, wherein the first pipe 43 is configured to connect a first liquid source S1 to the main body 40, and the second pipe 45 is configured to connect a second liquid source S2 to the main body 40. It should be appreciated that, the slurry dispensing unit 18' may further include one or more other pipes for connecting one or more other liquid sources to the main body 40 (the other pipes and liquid sources are not depicted in FIG. 9 for the sake of simplicity). The first liquid source S1, the second liquid source S2, and other liquid sources (not shown) are configured to store and provide multiple liquids including different slurry components of the slurry, such as different sizes of abrasive particles, pH buffer solutions, oxidants, surfactants, polishing rate inhibitors, corrosion inhibitor, hydrophilic material, or combinations thereof. For example, in accordance with some embodiments, the first liquid source S1 is configured to provide a first liquid F1 including abrasive particles, pH buffer solutions, oxidants, and surfactants, and the second liquid source S2 is configured to provide a second liquid F2 including polishing rate inhibitors.

In accordance with some embodiments, the main body 40 has a mixer 50/51 (see FIGS. 10 and 11) therein for mixing the liquids from the liquid sources, which will be further illustrated later.

As shown in FIG. 9, a controller 44 is provided in the first pipe 43 and configured to control the connection and/or delivery rate of the first fluid F1 to the mixer in the main body 40, and a controller 46 is also provided in the second pipe 45 and configured to control the connection and/or delivery rate of the second fluid F2 to the mixer in the main body 40. Both the controllers 44 and 46 may comprise elements such as valves, flow meters, sensors, and the like.

Furthermore, in accordance with some embodiments, the detection unit described above (such as the detection unit 24'/24"/24''' in FIGS. 6 to 8) is electrically connected to the controllers 44 and 46 in the first and second pipes 43 and 45, and the controllers 44 and 46 can control the connection and/or delivery rate of the first and second fluids F1 and F2 to the mixer in the main body 40 according to a detection signal from the detection unit.

For example, in accordance with some embodiments, in the main polishing stage of the CMP process, the controller 44 controls the connection of the first liquid source S1 to the main body 40 to be opened, so that only the first fluid F1 stored in the first liquid source S1 can flow to the main body 40 and then be injected by the nozzle 41 onto the polishing pad 14 (FIG. 1). Next, after the detection unit 24'/24"/24'" (FIGS. 6 to 8) detects the endpoint of the main polishing stage (i.e. start the transition stage of the CMP process), both the controllers 44 and 46 control the connections of the first and second liquid sources S1 and S2 to the main body 40 to be opened according to the detection signal from the detection unit, so that both the first and second fluids F1 and F2 stored in the first and second liquid sources S1 and S2 can flow to the main body 40 to be mixed by the mixer therein and then can be injected together by the nozzle 41 onto the polishing pad 14 (FIG. 1). In accordance with some embodiments, the delivery rate of the first fluid F1 is different from (for example, greater than) that of the second fluid F2, which is controlled by the controllers 44 and 46.

Figure 10:
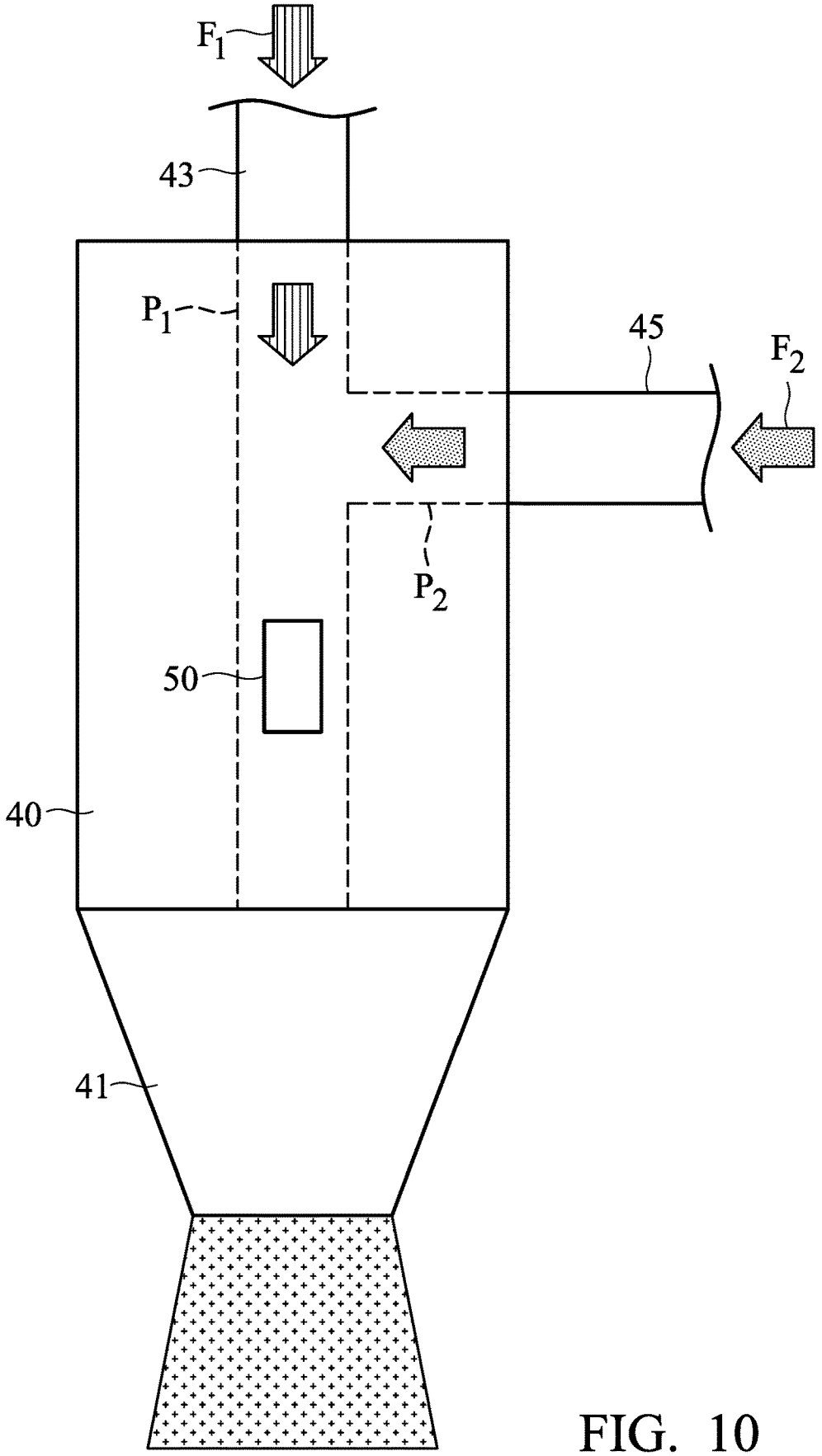
FIG. 10 is a schematic diagram illustrating an active mixer, in accordance with some embodiments.

FIG. 10 is a schematic diagram illustrating an active mixer 50 of the slurry dispensing unit in FIG. 9, in accordance with some embodiments. As shown in FIG. 10, two flow paths P1 and P2 are formed in the main body 40. One end of the flow path P1 is connected to the first pipe 43, and the other end of the flow path P1 is connected to the nozzle 41. One end of the second path P2 is connected to the second pipe 45, and the other end of the second path P2 is connected to the first path P1. The active mixer 50 is disposed in the first path P1 and downstream of the intersection of the first and second paths P1 and P2 in order to mix the first liquid F1 and the second liquid F2 flowing through the main body 40 to the nozzle 41. In accordance with some embodiments, the active mixer 50 is a mixer which can provide an external force to stir fluids, for example, an ultrasonic mixer, a pressure-driven mixer, an electromagnetic mixer, an electromechanical mixer, and the like. The active mixer 50 can effectively mix the first liquid F1 and the second liquid F2 with high viscosity.

Figure 11:
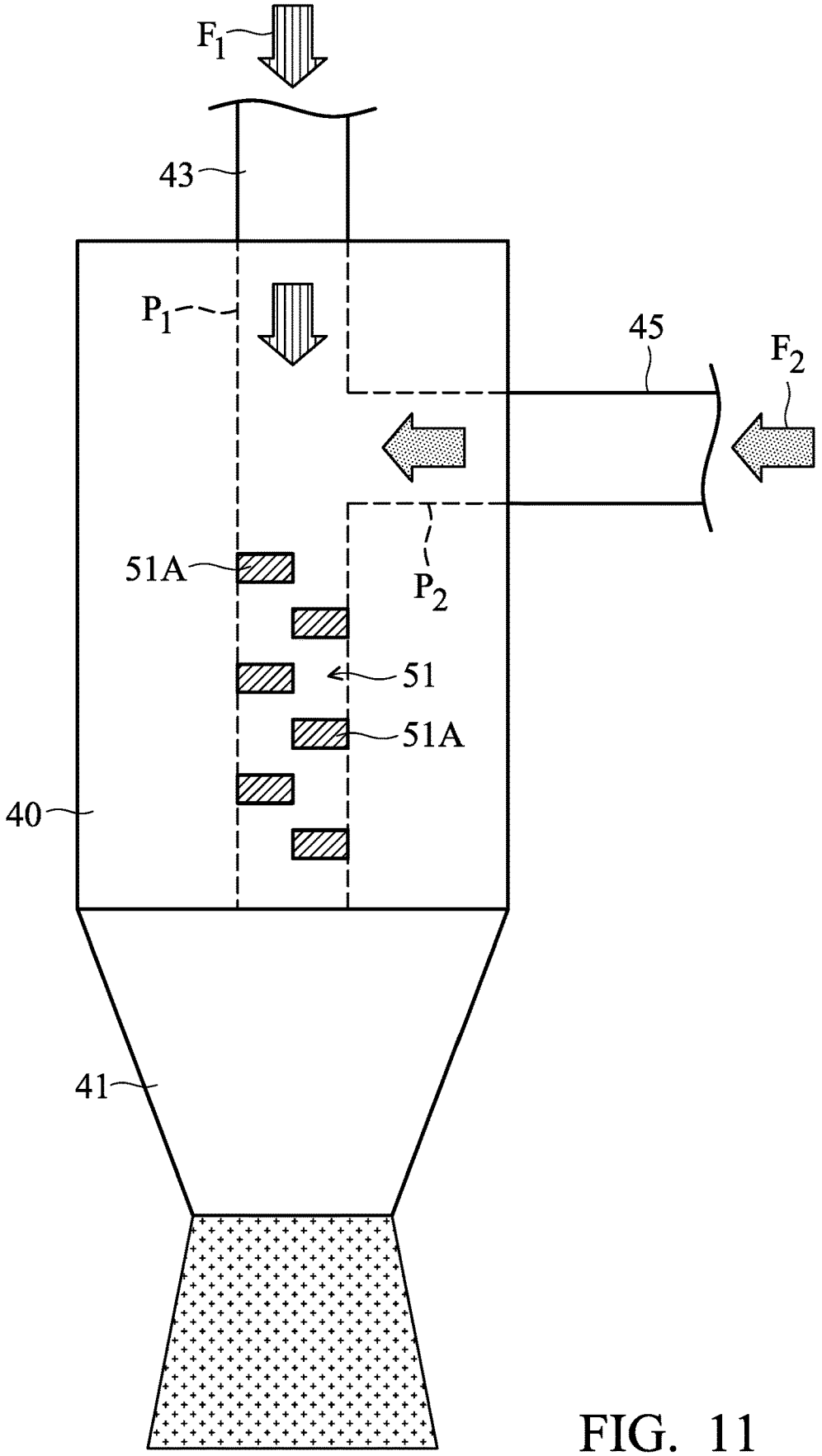
FIG. 11 is a schematic diagram illustrating a passive mixer, in accordance with some embodiments.

FIG. 11 is a schematic diagram illustrating a passive mixer 51 of the slurry dispensing unit in FIG. 9, in accordance with some embodiments. As shown in FIG. 11, similarly, the passive mixer 51 is also disposed in the first path P1 and downstream of the intersection of the first and second paths P1 and P2 in order to mix the first liquid F1 and the second liquid F2 flowing through the main body 40 to the nozzle 41. Specifically, the passive mixer 51 includes multiple partitions 51A disposed on the wall of the first path P1 and arranged in a staggered manner, so as to change and complicate the shape of the first path P1, thereby facilitating mixing of the first liquid F1 and the second liquid F2. It should be appreciated that the structure of the passive mixer 51 described above is an example, and it may comprise other variations. The passive mixer 51 can effectively mix the first liquid F1 and the second liquid F2 with low viscosity.

Referring back to FIG. 9, in accordance with some embodiments, the slurry dispensing unit 18' also includes a pipe 47 (additional pipe) configured to connect a washing fluid source S3 to the main body 40. The washing fluid source S3 is configured to store and provide a washing fluid F3 (for example, DI water or other applicable cleaning solutions) to clean the mixer 50/51 (FIGS. 10 and 11) and the main body 40, so as to reduce the mixture of the first and second liquids F1 and F2 remained. Although not shown, another pipe which is connected to the main body 40 and configured to allow the washing fluid F3 to exit the main body 40 is also provided. Furthermore, a controller 48 is also provided in the pipe 47 and configured to control the connection and/or delivery rate of the washing fluid F3 to the mixer 50/51 (FIGS. 10 and 11) in the main body 40. For example, in accordance with some embodiments, after the detection unit 24'/24"/24'" (FIGS. 6 to 8) detects the endpoint of the over polishing stage of the CMP process, the controller 48 controls the connection of the washing liquid sources S3 to the main body 40 to be opened according to the detection signal from the detection unit, so that the washing fluid F3 stored in the washing fluid source S3 can flow to and clean the main body 40 and the mixer therein.

Figure 12:
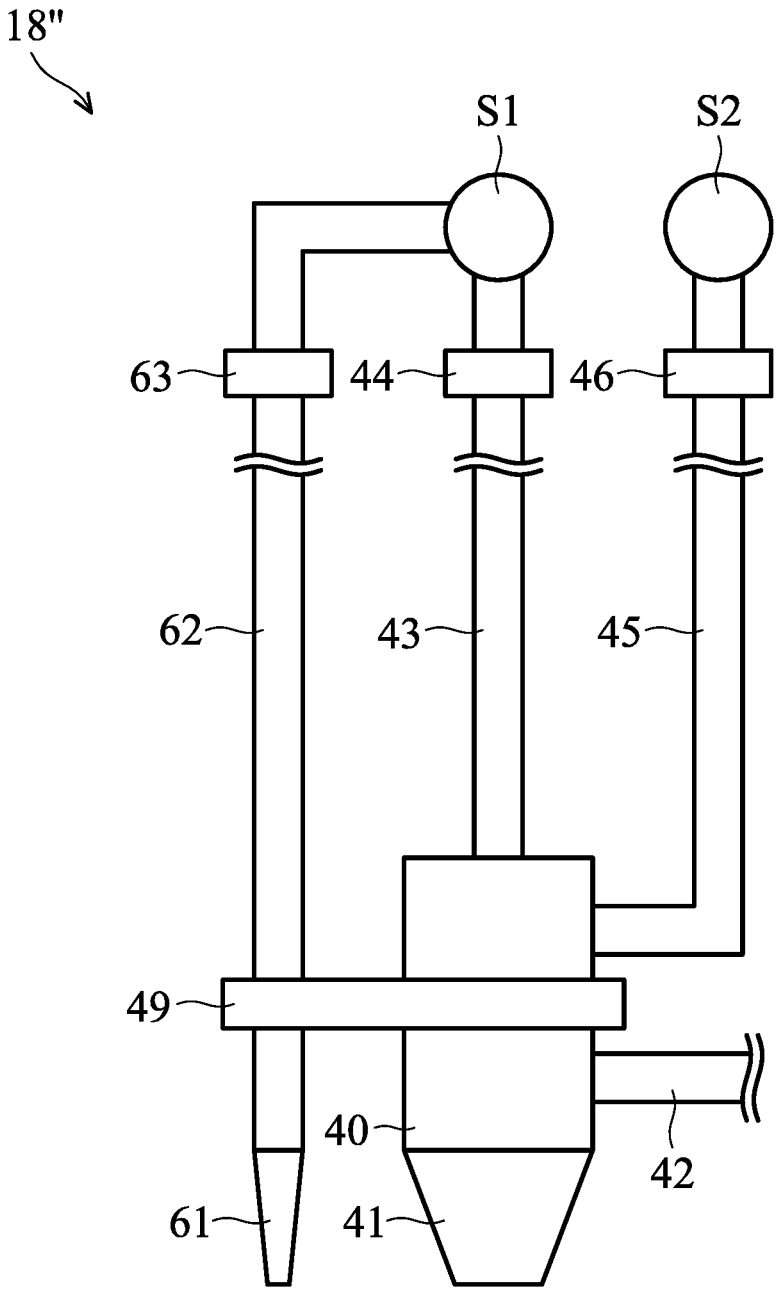
FIG. 12 is a schematic diagram of partial elements of another slurry dispensing unit, in accordance with some embodiments.

FIG. 12 is a schematic diagram of partial elements of another slurry dispensing unit 18", in accordance with some embodiments. The slurry dispensing unit 18" differs from the slurry dispensing unit 18' shown in FIG. 9 in that the washing fluid source S3 is omitted. Instead, as shown in FIG. 12, the slurry dispensing unit 18" further includes a second nozzle 61 and a third pipe 62 configured to connect the first liquid source S1 to the second nozzle 61. The third pipe 62 is connected to the main body 40 through a bracket 49, so that the third pipe 62 and the second nozzle 61 are movable along with the main body 40. In addition, a controller 63 is provided in the third pipe 62 and configured to control the connection and/or delivery rate of the first fluid F1 to the second nozzle 61.

With the above configurations, the slurry dispensing unit 18" does not need to wash or clean the main body 40 and the mixer 50/51 (FIGS. 10 and 11) therein between two processing stages, and hence reducing the cost and time of the CMP process. For example, in accordance with some embodiments, in the main polishing stage of the CMP process, the controller 63 controls the connection of the first liquid source S1 to the second nozzle 61 to be opened, so that only the first fluid F1 stored in the first liquid source S1 can be injected by the second nozzle 61 onto the polishing pad 14 (FIG. 1). Next, after the detection unit 24'/24"/24'" (FIGS. 6 to 8) detects the endpoint of the main polishing stage (i.e. start the transition stage of the CMP process), both the controllers 44 and 46 control the connections of the first and second liquid sources S1 and S2 to the main body 40 to be opened according to the detection signal from the detection unit, so that both the first and second fluids F1 and F2 stored in the first and second liquid sources S1 and S2 can flow to the main body 40 to be mixed by the mixer therein and then can be injected together by the nozzle 41 (first nozzle) onto the polishing pad 14 (FIG. 1). Since the first fluid F1 is dispensed by the second nozzle 61, which is independent from the mixture of the first and second fluids F1 and F2 in the main body 40, the washing work for the main body 40 and the mixer therein can be omitted.

Figure 13:
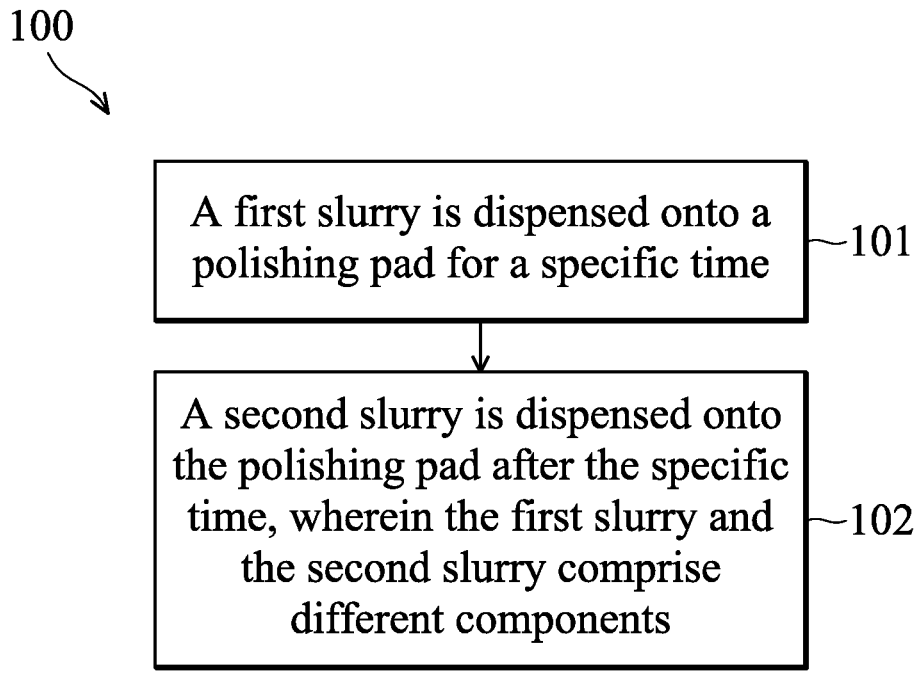
FIG. 13 is a flow chart of a slurry dispensing method for a CMP process, in accordance with some embodiments.

FIG. 13 is a flow chart of a slurry dispensing method 100 for a CMP process, in accordance with some embodiments. In operation 101, a first slurry is dispensed onto a polishing pad for a specific time. The first slurry may be the first fluid F1 described in the embodiments of FIGS. 9 to 12. The endpoint of the specific time may correspond to the endpoint of main polishing stage, transition stage, or over polishing stage of the CMP process, for example, which is based on actual requirements. In accordance with some embodiment, the endpoints of the main polishing stage, the transition stage, and the over polishing stage of the CMP process are detected by using a detection unit, such as a current detection unit, an optical detection unit, a friction unit, and the like. However, it should be appreciated that the specific time for dispensing the first slurry may also be determined and preset by the user based on experience or experimental results, wherein the specific time may also comprise other time in addition to the endpoint of main polishing stage, transition stage, or over polishing stage. In operation 102, a second slurry is dispensed onto the polishing pad after the specific time, wherein the first slurry and the second slurry comprise different components. The second slurry may be the mixture of the first fluid F1 and the second fluid F2 described in the embodiments of FIGS. 9 to 12. In accordance with some embodiments, the second slurry is dispensed onto the polishing pad which is coated with the first slurry, that is, the first slurry and the second slurry are successively dispensed onto the polishing pad for CMP.

As described above, embodiments of a slurry dispensing unit, a CMP apparatus using the slurry dispensing unit, and a slurry dispensing method for a CMP process are provided. By mixing and supplying different slurry components according to various processing stages of the CMP process using the slurry dispensing unit in the CMP apparatus, the performance of CMP process can be enhanced. For example, as the slurry components are selectively injected onto the polishing pad when needed for the specific processing stages of the CMP process, the chance of the slurry components working against other processing stages is reduced. Furthermore, the undesired interaction among the slurry components that are needed for different processing stages and the usage amount and cost of the slurry for the CMP process can also be effectively reduced.

In accordance with some embodiments, a slurry dispensing unit for a CMP apparatus is provided. The slurry dispensing unit includes a nozzle, a mixer, a first fluid source, and a second fluid source. The nozzle is configured to dispense a slurry. The mixer is disposed upstream of the nozzle. The first fluid source is connected to the mixer through a first pipe and configured to provide a first fluid including a first component of the slurry. The second fluid source is connected to the mixer through a second pipe and configured to provide a second fluid including a second component of the slurry, wherein the second component is different from the first component.

In accordance with some embodiments, a CMP apparatus is provided. The CMP apparatus includes a housing, a polishing pad, and a slurry dispensing unit. The polishing pad is disposed in the housing and configured to mechanically polish a wafer. The slurry dispensing unit is provided in the housing and configured to dispense a slurry onto the polishing pad. The slurry dispensing unit includes a nozzle, a mixer, a first fluid source, and a second fluid source. The nozzle is configured to dispense the slurry. The mixer is disposed upstream of the nozzle. The first fluid source is connected to the mixer through a first pipe and configured to provide a first fluid including a first component of the slurry. The second fluid source is connected to the mixer through a second pipe and configured to provide a second fluid including a second component of the slurry, wherein the second component is different from the first component.

In accordance with some embodiments, a slurry dispensing method for a CMP process is provided. The slurry dispensing method includes dispensing a first slurry onto a wafer for a specific time. The polishing method also includes dispensing a second slurry onto the wafer after the specific time, wherein the first slurry and the second slurry comprise different components.

Although embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. In addition, each claim constitutes a separate embodiment, and the combination of various claims and embodiments are within the scope of the disclosure.

What is claimed is:

1. A chemical mechanical polishing (CMP) apparatus, comprising:

a polishing pad configured to mechanically polish a wafer; and a slurry dispensing unit configured to dispense a slurry onto the polishing pad, wherein the slurry dispensing unit comprises:

a nozzle configured to dispense the slurry;

a main body connected to the nozzle and having a mixer therein;

a first fluid source connected to the mixer through a first pipe and configured to provide a first fluid including a first component of the slurry;

a second fluid source connected to the mixer through a second pipe and configured to provide a second fluid including a second component of the slurry, wherein the second component is different from the first component; and a pivotable arm connected to the main body and configured to allow the main body, the mixer therein, the first and second fluid sources, along with the nozzle to move together toward and away from the polishing pad.

2. The chemical mechanical polishing apparatus as claimed in claim 1, wherein the slurry dispensing unit further comprises a first controller which is provided in the first pipe and configured to control the connection and/or delivery rate of the first fluid to the mixer, and the slurry dispensing unit further comprises a second controller provided in the second pipe and configured to control the connection and/or delivery rate of the second fluid to the mixer.

3. The chemical mechanical polishing apparatus as claimed in claim 2, wherein the delivery rate of the first fluid is different from that of the second fluid, which is controlled by the first and second controllers in the first and second pipes, respectively.

4. The chemical mechanical polishing apparatus as claimed in claim 2, further comprising at least one sensor configured to detect an endpoint of a processing stage of a CMP process for the wafer and send a detection signal to the first and second controllers, so that the first and second controllers control the connection and/or delivery rate of the first and second fluids to the mixer according to the detection signal, wherein the processing stage comprises a main polishing stage, a transition stage, or an over polishing stage of the CMP process.

5. The chemical mechanical polishing apparatus as claimed in claim 4, wherein the sensor is an optical sensor.

6. The chemical mechanical polishing apparatus as claimed in claim 4, wherein the sensor is a friction sensor.

7. The chemical mechanical polishing apparatus as claimed in claim 4, wherein the sensor is a current sensor.

8. The chemical mechanical polishing apparatus as claimed in claim 4, wherein the slurry dispensing unit dispenses a first slurry onto the polishing pad in a first processing stage of the CMP process, and dispenses a second slurry onto the polishing pad in a second processing stage of the CMP process after the endpoint of the first processing stage, wherein the first slurry and the second slurry comprise different components.

9. The chemical mechanical polishing apparatus as claimed in claim 8, wherein the second slurry is dispensed onto the polishing pad while the polishing pad is coated with the first slurry.

10. The chemical mechanical polishing apparatus as claimed in claim 4, wherein the sensor detects the endpoint of the processing stage of the CMP process in-situ.

11. A chemical mechanical polishing (CMP) apparatus, comprising:

a polishing pad configured to mechanically polish a wafer; and a slurry dispensing unit configured to dispense a slurry onto the polishing pad, wherein the slurry dispensing unit comprises:

a first nozzle configured to dispense a slurry;

a main body connected to the first nozzle and having a mixer therein;

a first fluid source connected to the mixer through a first pipe and configured to provide a first fluid including a first component of the slurry;

a second fluid source connected to the mixer through a second pipe and configured to provide a second fluid including a second component of the slurry, wherein the second component is different from the first component;

a second nozzle connected to the first fluid source through a third pipe and configured to dispense the first fluid, wherein the second nozzle is independent of the first nozzle;

a bracket configured to connect the third pipe and the second nozzle to the main body; and a pivotable arm connected to the main body and configured to allow the main body, the mixer therein, the first and second fluid sources, along with the first nozzle and the second nozzle to move together toward and away from the polishing pad.

12. The chemical mechanical polishing apparatus as claimed in claim 11, wherein the slurry dispensing unit further comprises a first controller which is provided in the first pipe and configured to control the connection and/or delivery rate of the first fluid to the mixer.

13. The chemical mechanical polishing apparatus as claimed in claim 12, wherein the slurry dispensing unit further comprises a second controller which is provided in the second pipe and configured to control the connection and/or delivery rate of the second fluid to the mixer.

14. The chemical mechanical polishing apparatus as claimed in claim 11, wherein the mixer is an active mixer.

15. The chemical mechanical polishing apparatus as claimed in claim 11, wherein the mixer is a passive mixer.

16. The chemical mechanical polishing apparatus as claimed in claim 11, wherein the slurry dispensing unit further comprises a washing fluid source which is connected to the mixer through an additional pipe and configured to provide a washing fluid to clean the mixer.

17. The chemical mechanical polishing apparatus as claimed in claim 16, wherein the slurry dispensing unit further comprises a controller which is provided in the additional pipe and configured to control the connection and/or delivery rate of the washing fluid to the mixer.

18. The chemical mechanical polishing apparatus as claimed in claim 11, wherein the slurry dispensing unit further comprises a controller which is provided in the third pipe and configured to control the connection and/or delivery rate of the first fluid to the second nozzle.

19. The chemical mechanical polishing apparatus as claimed in claim 11, wherein the slurry dispensing unit further comprising:

a first controller provided in the first pipe and configured to control the connection of the first fluid source and the mixer;

a second controller provided in the second pipe and configured to control the connection of the second fluid source and the mixer; and a third controller provided in the third pipe and configured to control the connection of the first fluid source and the second nozzle; and the chemical mechanical polishing apparatus further comprising at least one sensor configured to detect an endpoint of a processing stage of a CMP process for a wafer and send a detection signal to the first, second and third controllers.

20. A chemical mechanical polishing (CMP) apparatus, comprising:

a polishing pad configured to mechanically polish a wafer; and a slurry dispensing unit configured to dispense a slurry onto the polishing pad, wherein the slurry dispensing unit comprises:

a nozzle configured to dispense a slurry;

a main body connected to the nozzle and having a mixer therein;

a first fluid source connected to the mixer through a first pipe and configured to provide a first fluid including a first component of the slurry;

a second fluid source connected to the mixer through a second pipe and configured to provide a second fluid including a second component of the slurry;

a washing fluid source connected to the mixer through a third pipe and configured to provide a washing fluid to clean the mixer; and a pivotable arm connected to the main body and configured to allow the main body, the mixer therein, the first, second and washing fluid sources, along with the nozzle to move together toward and away from the polishing pad.

* * * * *